US009039028B2

(12) United States Patent
Kobayashi et al.

(10) Patent No.: US 9,039,028 B2
(45) Date of Patent: May 26, 2015

(54) NURSING WHEELCHAIR

(75) Inventors: Mutsumi Kobayashi, Okaya (JP); Hiroshi Kobayashi, Okaya (JP); Hiroshi Miyazawa, Okaya (JP)

(73) Assignee: IDEA SYSTEM CO., LTD., Okaya, Nagano (JP)

( * ) Notice: Subject to any disclaimer, the term of this patent is extended or adjusted under 35 U.S.C. 154(b) by 104 days.

(21) Appl. No.: 13/879,766

(22) PCT Filed: Sep. 12, 2011

(86) PCT No.: PCT/JP2011/070751

§ 371 (c)(1), (2), (4) Date: Apr. 16, 2013

(87) PCT Pub. No.: WO2012/036131

PCT Pub. Date: Mar. 22, 2012

(65) Prior Publication Data

US 2013/0264800 A1 Oct. 10, 2013

(30) Foreign Application Priority Data

Sep. 13, 2010 (JP) ..... 2010-204197

(51) Int. Cl.

| | |
|---|---|
| ***A61G 5/10*** | (2006.01) |
| ***A61G 5/08*** | (2006.01) |
| ***A61G 5/00*** | (2006.01) |
| ***A61G 7/10*** | (2006.01) |
| *A61G 13/12* | (2006.01) |
| *A61G 5/12* | (2006.01) |

(52) U.S. Cl.

CPC ..... *A61G 5/08* (2013.01); *A61G 2005/0875* (2013.01); *A61G 5/006* (2013.01); *A61G 5/1002* (2013.01); *A61G 5/1056* (2013.01); *A61G 5/1067* (2013.01); *A61G 7/1032* (2013.01); *A61G 7/1046* (2013.01); *A61G 13/125* (2013.01); *A61G 2005/128* (2013.01)

(58) Field of Classification Search

CPC ..... A61G 5/02; A61G 5/1002; A61G 5/1056; A61G 5/1062; A61G 5/1067; A61G 2200/34

USPC ..... 280/304.1, 250.1, 650, 657, 647, 47.4, 280/643, 87.05

See application file for complete search history.

(56) References Cited

U.S. PATENT DOCUMENTS

| | | | | |
|---|---|---|---|---|
| 3,990,745 | A * | 11/1976 | Rodaway | 297/440.16 |
| 4,266,305 | A * | 5/1981 | Kavaloski et al. | 4/480 |
| 5,896,592 | A * | 4/1999 | Santa Cruz et al. | 4/246.1 |

(Continued)

FOREIGN PATENT DOCUMENTS

| | | | |
|---|---|---|---|
| JP | 62-101227 | A | 5/1987 |
| JP | 62-119906 | U | 7/1987 |

(Continued)

*Primary Examiner* — J. Allen Shriver, II
*Assistant Examiner* — Emma K Frick
(74) *Attorney, Agent, or Firm* — Birch, Stewart, Kolasch & Birch, LLP

(57) ABSTRACT

The present invention addresses the problem of providing a nursing wheelchair, comprising a seat member which deploys on a frame body to form a seat. The nursing wheelchair readily allows transfer of a person receiving care, and is lightweight and easy to operate. A nursing wheelchair (1) comprises seat members (7*a*, 7*b*) which deploy on seat support frames (14*a*, 14*b*) constituting part of a frame body (2) in order to form a seat.

8 Claims, 7 Drawing Sheets

(56) References Cited

U.S. PATENT DOCUMENTS

| | | | | |
|---|---|---|---|---|
| 6,547,265 | B1 * | 4/2003 | Enge et al. | 280/47.38 |
| 7,475,437 | B2 * | 1/2009 | Herrera-Gurrola | 4/246.3 |
| 2007/0273124 | A1 | 11/2007 | Nishi | |

FOREIGN PATENT DOCUMENTS

| | | | |
|---|---|---|---|
| JP | S 63-8025 | * | 1/1988 |
| JP | 3-188853 | A | 8/1991 |
| JP | 6-29522 | U | 4/1994 |
| JP | 10-108878 | A | 4/1998 |
| JP | 2000-300614 | A | 10/2000 |
| JP | 2001-276141 | A | 10/2001 |
| JP | 2002-306542 | A | 10/2002 |
| JP | 2008-104813 | A | 5/2008 |
| JP | 2009-77913 | A | 4/2009 |
| JP | 2009-172108 | * | 8/2009 |
| JP | 2009-172108 | A | 8/2009 |
| WO | WO 2005/053592 | A1 | 6/2005 |

* cited by examiner 1
2
6
40
41
42
8
24
7
9

NURSING WHEELCHAIR

TECHNICAL FIELD

The present invention relates to a nursing wheelchair having a seat surface member configured to be deployed over a frame member to form a seat surface.

BACKGROUND ART

There are various types of nursing wheelchairs to be used for care receivers having difficulty in walking, and hence there are various types of mechanisms therefor. In recent years, society is aging and hence the nursing wheelchairs are subject to increasing demand. However, in the case of nursing wheelchairs used for temporary transferences such as transference from a bed to a toilet, a care person needs to hold the care receiver when loading the care receiver thereon. Therefore, the care person bears a heavy burden on his or her lower back, which has been a problem in nursing care. On the other hand, when it is difficult for a single care person to hold the care receiver, a plurality of care persons need to assist the loading. Therefore, there arises a problem that although the burden on the lower back per care person is reduced, working efficiency is lowered.

As an example of the nursing wheelchair of the related art proposed for solving such problems, there is a nursing wheelchair 100 described in PTL 1 (see FIG. 8A, FIG. 8B). The nursing wheelchair 100 includes belt conveyers 101, 102, 103 and a hoisting apparatus 104, and has a configuration in which the belt conveyers 101, 102, 103 are brought into proximity to the care receiver on the bed, the care receiver is transferred onto the nursing wheelchair by the belt conveyers 101, 102, 103 being operated in a state of lying (see FIG. 8A), and the belt conveyers 101, 102, 103 are transformed into a chair shape (see FIG. 8B) after the completion of transference.

According to the nursing wheelchair of the related art as the nursing wheelchair 100 described above, the care receiver can be loaded with a single care person. However, this apparatus is inevitably a large-scale apparatus provided with a complex mechanism. In addition, because of heaviness, a heavy labor is required for the transference. There is also a problem that a physical burden of the care receiver when transferred by the belt conveyer is not negligible.

In contrast, a nursing wheel chair configured in such a manner that a seat and a seatback are demountably mountable for the purpose of facilitating transference when the care receiver is transferred between a platform of the bed or the toilet and the nursing wheelchair is proposed (see PTL 2 to PTL 9).

CITATION LIST

Patent Literature

PTL1: JP-A-10-108878
PTL2: JP-A-2008-104813
PTL3: JP-A-2002-306542
PTL4: JP-A-2000-300614
PTL5: JP-A-03-188853
PTL6: JP-A-62-101227
PTL7: JP-UM-A-06-029522
PTL8: JP-UM-A-62-119906
PTL9: WO2005/053592

SUMMARY OF INVENTION

Technical Problem

In recent years, the nursing wheelchair is demanded to be capable of nursing not by a plurality of care persons, but by a single care person, and to reduce physical burdens of both the care person and a care receiver, and the question is how such demands are realized with a light-weight and easy-to-operate structure in terms of usage and costs with good operability.

In view of such circumstances, it is an object of the present invention to provide a nursing wheelchair including a seat surface member to be deployed over a frame member, and having a light-weight, easy-to-operate structure with good operability that allows easy transference of a care receiver having a difficulty in walking.

Solution to Problem

The present invention solves the above-described problems by solution to problem described below.

A nursing wheelchair according to the present invention includes a seat surface member forming a seat surface by being deployed over a seat supporting frame which forms part of a frame member.

Advantageous Effects of Invention

According to the present invention, a nursing wheelchair including a seat surface member to be deployed over a frame member, and having a light-weight, easy-to-operate structure with good operability that allows easy transference of a care receiver having a difficulty in walking is realized.

DESCRIPTION OF EMBODIMENTS

Figure 1A:
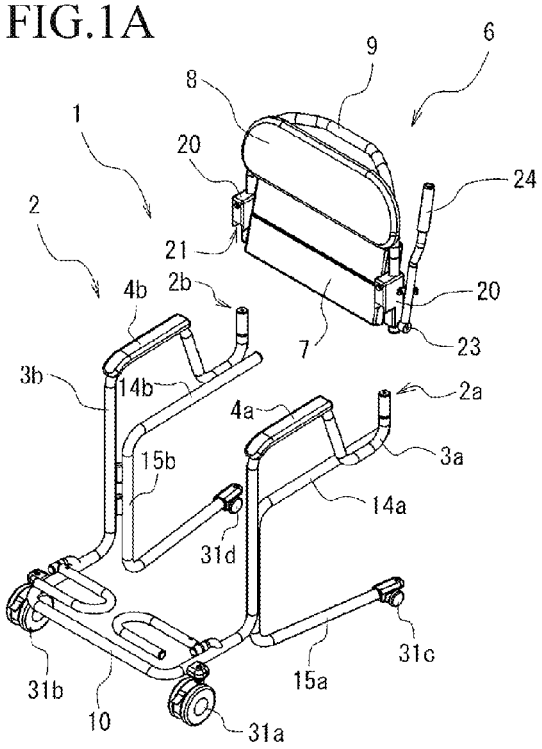
FIG. 1A to FIG. 1D are schematic drawings illustrating an example of a nursing wheelchair according to an embodiment of the present invention.

Referring now to the drawings, embodiments of the present invention will be described in detail. A nursing wheelchair 1 according to an embodiment of the present invention is a nursing wheelchair in which seat surface members 7*a*, 7*b* are deployed over a frame member 2 to form a seat surface as illustrated in FIG. 1A to FIG. 1D (the structure and the operation will be described later). Here, a seat 7 provided with the seat surface members 7*a*, 7*b* is demountably supported on the frame member 2. In this embodiment, the seat 7, a backrest 8, a push handle 9 and the like are integrated into one mechanism (a seat backrest mechanism 6 described later) as a demountably mountable attachment. It is also possible to configure respective members so as to be a demountably mountable mechanism separately in a form of only the seat, only the backrest, and so force (not illustrated).

As a modification, a structure in which the seat 7 is supported so as to be rotatable (in this case, both demountably mountable, and not demountably mountable configurations are conceivable) with respect to the frame member 2 is also applicable. An example of the structure in which the seat 7 (the seat backrest mechanism 6 in this case) is rotatably supported on the frame member 2 will be described later.

Figure 1B:
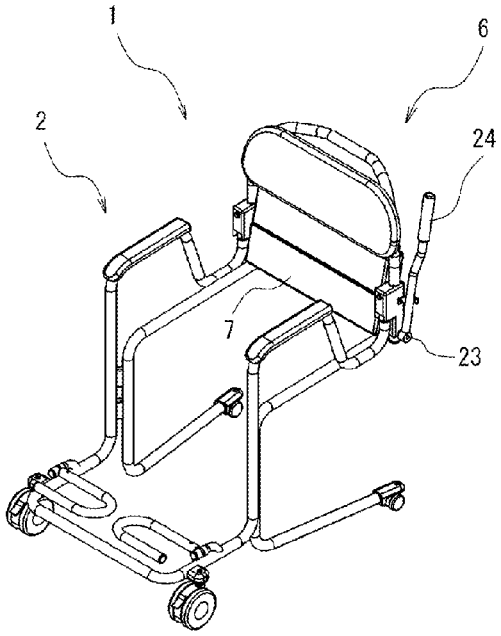
Figure 1C:
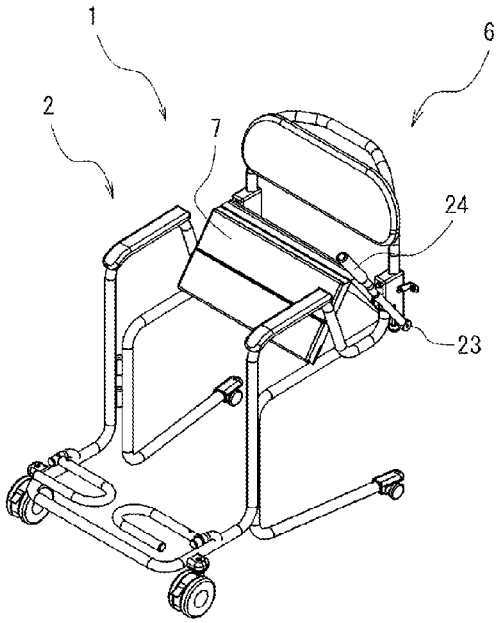
Figure 1D:
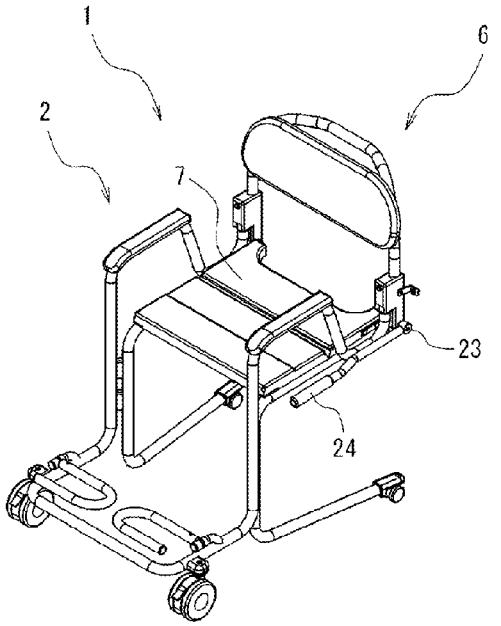
Figure 2A:
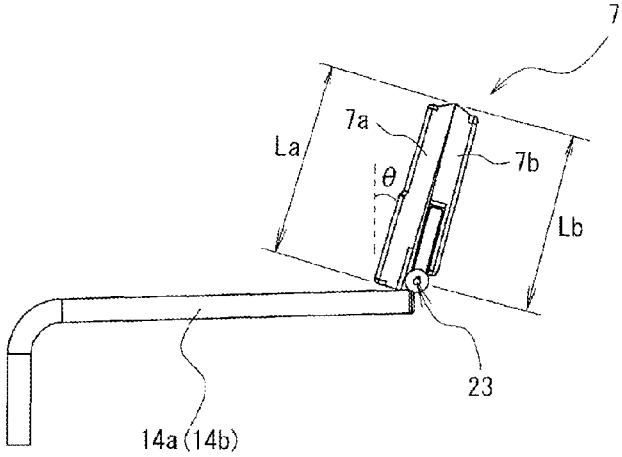
FIG. 2A to FIG. 2D are explanatory drawings for explaining folding and deploying operations of a seat of the nursing wheelchair illustrated in FIG. 1A to FIG. 1D.
Figure 2B:
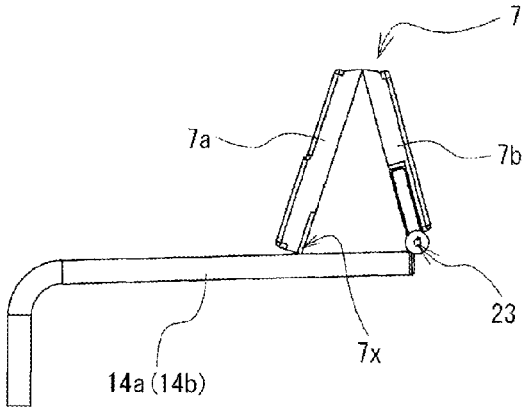
Figure 2C:
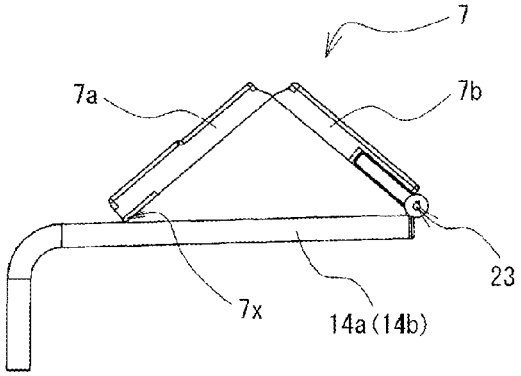
Figure 2D:
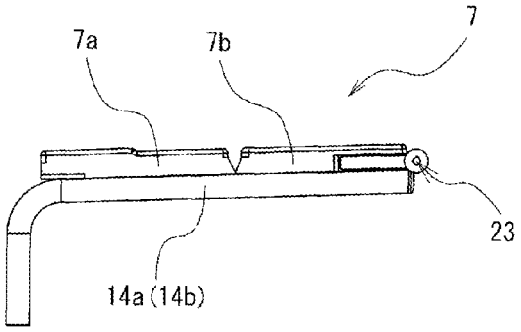

As illustrated in FIG. 1A to FIG. 1D, and FIG. 2A to FIG. 2D, the seat 7 is capable of forming a seat surface by being deployed over seat supporting frames 14*a*, 14*b* of the frame member 2, whereby the care receiver can be seated. Here, FIG. 2A and FIG. 2D are explanatory drawings (schematic side views) for explaining a condition in which the seat 7 is deployed over the seat supporting frames 14*a*, 14*b*.

First of all, the structure of the nursing wheelchair 1 according to this embodiment will be described.

The frame member 2 is formed by coupling two side frames 3*a*, 3*b* provided on the left and the right with a front bar 10 provided only on the front thereof. In this embodiment, although the two side frame 3*a* and 3*b* are formed into a lateral symmetry pair, the invention is not limited to the symmetry. Although a single front bar is provided in this embodiment, the invention is not limited thereto.

In this embodiment, bent portions projecting convexly upward at intermediate sections of the side frames 3*a*, 3*b* are provided to constitute armrest portions 4*a*, 4*b*.

A configuration in which the armrest portions 4*a*, 4*b* are formed separately and coupled to the side frames 3*a*, 3*b* is also applicable (not illustrated).

Here, the distance between the side frame 3*a* and the side frame 3*b* (that is, equivalent to the length of the front bar 10) is set to be a length longer than a lateral width of the care receiver. Accordingly, in a state in which the seat and the backrest (the seat backrest mechanism 6 described later) is not mounted, the care receiver in a state of sitting on the platform of a bed or a seat of a toilet can enter between the side frame 3*a* and the side frame 3*b* from behind together with the platform.

As illustrated in FIG. 1A to FIG. 1D, the seat supporting frames 14*a*, 14*b* to be coupled to the side frames 3*a*, 3*b* are provided with the longitudinal direction thereof arranged in the lateral direction (arranged in the horizontal direction). In addition, leg frames 15*a*, 15*b* to be coupled to distal ends of the seat supporting frames 14*a*, 14*b* are provided.

Here, the leg frames 15*a*, 15*b* are formed in a substantially L-shape as an example (see FIG. 1A to FIG. 1D). The term "substantially L-shape" has a configuration in which rear ends of a lower portions of the leg frames 15*a*, 15*b* are arranged downward of the seat supporting frames 14*a*, 14*b*, so that substantially angular C-shapes are formed in a state in which the seat supporting frames 14*a*, 14*b* and the leg frames 15*a*, 15*b* are coupled respectively.

The leg frames are not limited to the substantially L-shape, but may be a substantially inverted T-shape (not illustrated). The leg frames formed into a shape having a single column extending in the vertical direction and being bifurcated leftward and rightward on a lower side thereof and then extending rearward is also conceivable (not illustrated).

The nursing wheelchair 1 according to this embodiment also includes traveling wheels on a lower portion thereof (see FIG. 1A to FIG. 1D). As an example, two left and right front wheels 31*a*, 31*b* are provided on the side frames 3*a*, 3*b*, and two left and right rear wheels 31*c*, 31*d* are provided on the leg frames 15*a*, 15*b*. The traveling wheels are not limited to the four wheels, and the front wheels and the rear wheels may be either the same shape or different shapes. In addition to general wheels, they may be casters or universal traveling wheels.

In this embodiment, the rear wheels 31*c*, 31*d* provided on the rear ends of the lower portions of the leg frames 15*a*, 15*b* are formed to have a smaller diameter than that of the front wheels 31*a*, 31*b*. Accordingly, even when the height of the clearance of a lower portion of the platform where the care receiver is seated is low, the rear ends of the lower portions of the leg frames 15*a*, 15*b* may be inserted.

Subsequently, the seat backrest mechanism 6 will be described. As illustrated in FIG. 1A and FIG. 1B, the seat backrest mechanism 6 is provided with a structure demountably mountable with respect to the frame member 2. More specifically, the demountably mountable structure is formed into a shape in which rear end portions of the frame member 2 are bent to form extending portions 2*a*, 2*b* extending upward. In contrast, the seat backrest mechanism 6 includes fixing portions 20 for mounting and fixing the seat backrest mechanism 6 with respect to the frame member 2. Various structures are conceivable as the fixing portions 20. However, the fixing portions 20 of this embodiment each have a configuration including a cylindrical-shaped socket portion 21 having an inner diameter corresponding to the outer diameter of the extending portions 2*a*, 2*b* and opening downward.

Therefore, by fitting the extending portions 2*a*, 2*b* into the socket portions 21 provided on the fixing portions 20 of the seat backrest mechanism 6, the seat backrest mechanism 6 may be mounted and fixed to the frame member 2.

In this embodiment, the extending portions 2*a*, 2*b* are provided at rear end portions of the side frames 3*a*, 3*b*. However, a configuration in which the extending portions 2*a*, 2*b* are provided at rear end portions of the seat supporting frames 14*a*, 14*b* is also applicable.

The fixing portions 20 according to this embodiment includes a sliding mechanism that allows sliding movement of the socket portions 21 in the vertical direction (that is, the direction of extension of the extending portions 2*a*, 2*b*), as illustrated in FIG. 3A, FIG. 3B, and FIG. 4A, FIG. 4B. In this embodiment, a structure in which the entire parts of the fixing portions 20 provided with the socket portions 21 make a sliding movement is employed.

Figure 3A:
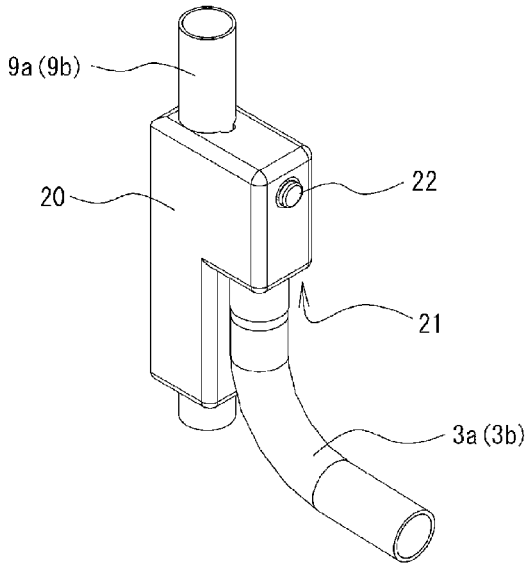
FIG. 3A and FIG. 3B are schematic drawings (perspective views) illustrating an example of a fixing portion of the nursing wheelchair illustrated in FIG. 1A to FIG. 1D.
Figure 3B:
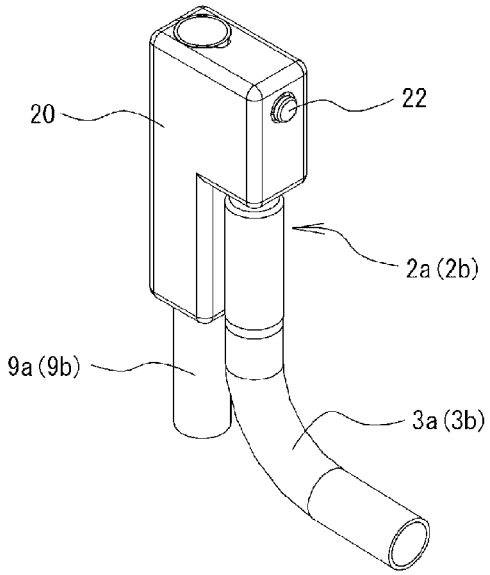

Here, FIG. 3A and FIG. 3B are perspective views (schematic drawings) of the fixing portion 20, and FIG. 3A illustrates a state in which the fixing portion 20 (the socket portion 21) has made a sliding movement to a lower position, and FIG. 3B illustrates a state in which the fixing portion 20 (socket portion 21) has made a sliding movement to an upper position. In contrast, FIG. 4A and FIG. 4B are cross-sectional side views (schematic views) of the fixing portion 20 corresponding to FIG. 3A and FIG. 3B, and FIG. 4A illustrates a state in which the fixing portion 20 (the socket portion 21) has made the sliding movement to a lower position, and FIG. 4B illustrates a state in which the fixing portion 20 (the socket portion 21) has made the sliding movement to the upper position.

Figure 4A:
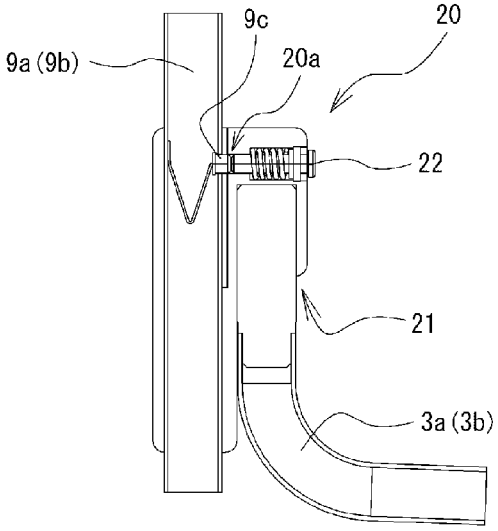
FIG. 4A and FIG. 4B are schematic drawings (cross-sectional views) illustrating an example of a fixing portion of the nursing wheelchair illustrated in FIG. 1A to FIG. 1D.

More specifically, a left side frame 9*a* and a right side frame 9*b* of a metallic substantially angular C-shape which constitute the push handle 9 are each provided with an engaging pin 9*c* projecting from an outer peripheral surface by being urged from the inside toward the outside of a tubular member which forms the frame as illustrated in FIG. 3A and FIG. 4A, and the engaging pins 9*c* engage engaging holes 20*a* provided in the fixing portions 20, whereby an operation that the fixing portions 20 are fixed to the left side frame 9*a* and the right side frame 9*b* is obtained.

Figure 4B:
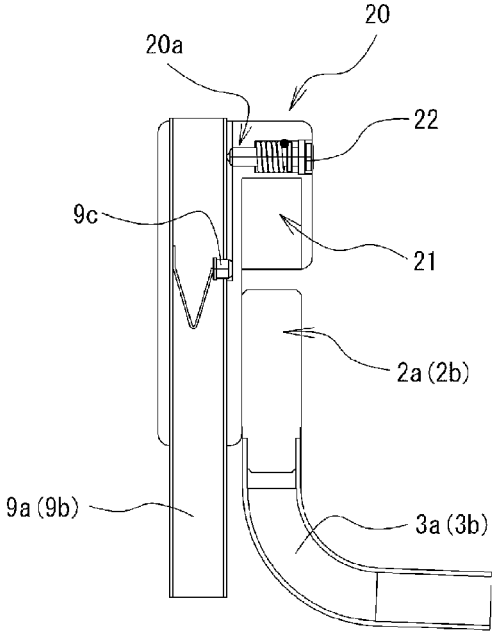

From the state described above, by pressing the engaging pin 9*c* from the outsides to the insides of the left side frame 9*a* and the right side frame 9*b* in a state of pressing release buttons 22 as illustrated in FIG. 3B and FIG. 4B, the engagement between the engaging pins 9*c* and the engaging holes 20*a* is released. Accordingly, the fixing portions 20 (the socket portions 21) are allowed to make a sliding movement vertically (the direction along the frame, that is, the direction of extension of the extending portions 2*a*, 2*b*) with respect to the left side frame 9*a* and the right side frame 9*b*.

Figure 5A:
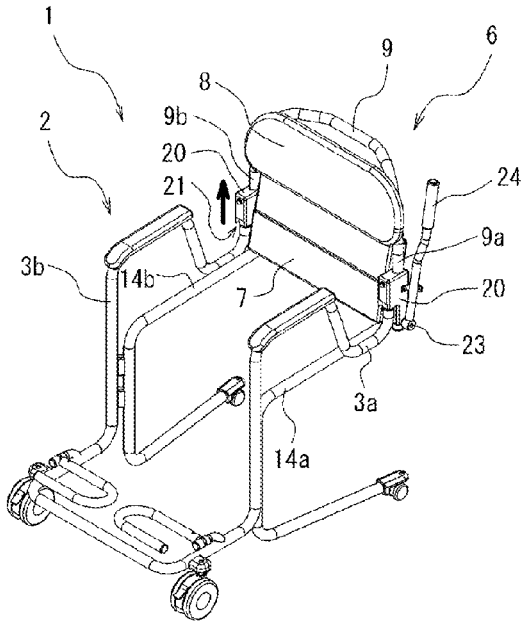
FIG. 5A to FIG. 5C are explanatory drawings for explaining a rotating operation of a seat backrest mechanism of the nursing wheelchair illustrated in FIG. 1A to FIG. 1D.
Figure 5B:
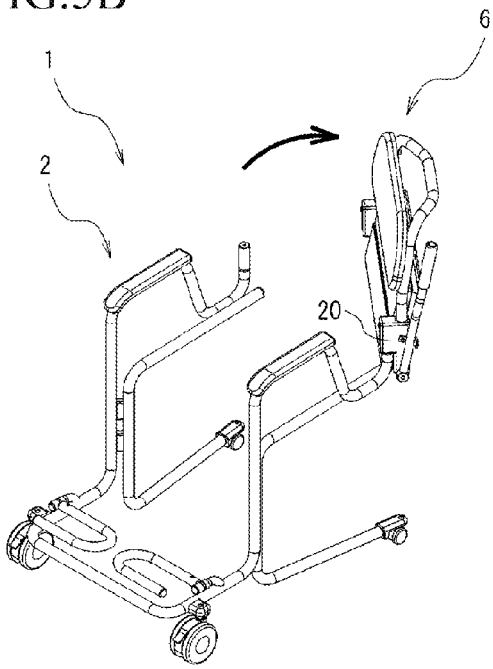
Figure 5C:
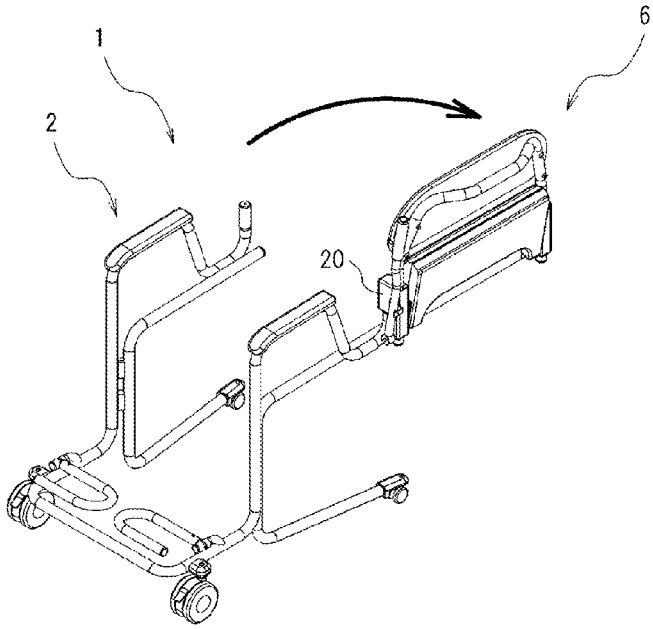

In this manner, with the fixing portions 20 having a sliding mechanism, by causing one of the left and right (the right side in FIG. 5A to FIG. 5C) fixing portions 20 (that is, the socket portions 21) to make a sliding movement upward in a state in which the seat backrest mechanism 6 is mounted on the frame member 2, for example, as illustrated in FIG. 5A to FIG. 5C, the seat backrest mechanism 6 may be rotatably supported by the frame member 2 only with the other (the left side in FIG. 5A to FIG. 5C) fixing portion 20. Therefore, an action to open and close may be caused by rotating the seat backrest mechanism 6 like a door. In this configuration, when placing the care receiver between the two left and right side frames 3*a*, 3*b*, an operation to remove and place the seat backrest mechanism 6 at a different place and remount the same later is not necessary, and such loading is achieved only by the sliding and rotating operation. Therefore, a force required for the operation is significantly reduced, and the workability is dramatically improved. Here, it is also conceivable that the configuration of the seat backrest mechanism 6 to be demountably mountable with respect to the frame member 2 is omitted and only a configuration for allowing the rotation is provided.

An one-direction door-type opening and closing operation is obtained when providing the above-described sliding mechanism on one of the fixing portions 20, and a selectable two-direction door-type opening and closing operation is obtained when providing the sliding mechanism on both of the fixing portions 20.

Subsequently, the seat 7 will be described. In this embodiment, the seat 7 is provided on the seat backrest mechanism 6. The seat 7 includes a seat surface member that forms the seat surface by being deployed over the seat supporting frames 14*a*, 14*b* of the frame member 2.

Here, the seat surface member only has to be able to form the seat surface by being deployed over the seat supporting frames 14*a*, 14*b*. In this embodiment, a structure having a plurality of the seat surface members coupled so as to be foldable and deployable is employed. Various materials such as metallic materials and wooden materials may be used in addition to a resin material such as urethane as a material that forms the seat surface members, and a structure in which a cushion material is also used on a seating surface is conceivable as a matter of course.

More specifically, as illustrated in FIG. 2A to FIG. 2D, the two seat surface members including the first seat surface member 7*a* at a front position and the second seat surface member 7*b* at a rear position when seated are provided. The number of the seat surface members is not limited to two. Also, the first seat surface member 7*a* and the second seat surface member 7*b* are coupled by hinges or resiliently deformable coupling members or the like so as to allow the angle formed therebetween to be changed.

As an operation thereof, the first and second seat surface members 7*a*, 7*b* are deployed over the seat supporting frames 14*a*, 14*b* (see FIG. 1D, FIG. 2D) by tilting the second seat surface member 7*b* and moving a distal end of the first seat surface member 7*a* forward along the seat supporting frames 14*a*, 14*b* (see FIG. 1C, FIG. 2B, FIG. 2C).

Accordingly, since the deployment of the seat 7 is achieved with a simple structure in which the first seat surface member 7*a* comes into sliding contact on the seat supporting frames 14*a*, 14*b*, a complex deployment mechanism is not necessary, and hence reduction in costs owing to the simplification is achieved.

Tilting of the second seat surface member 7*b* described above is performed by a tilting mechanism. In this embodiment, a rotary shaft member 23 provided on the second seat surface member 7*b* and a tilt lever 24 fixed to the rotary shaft member 23 are provided as the tilting mechanism. The rotary shaft member 23 is a metallic column-shaped (or cylindrical) member, penetrates through the metallic substantially angular C-shaped flame which constitutes the push handle 9, and couples a rear end portion of the seat 7 (here, the second seat surface member 7*b*) and the tilt lever 24.

In other words, a tiltable operation of the second seat surface member 7*b* is obtained by the structure of being rotatably supported by the metallic substantially angular C-shaped frame (here, the left side frame 9*a* and the right side frame 9*b*) which constitutes the push handle 9 by the rotary shaft member 23.

Instead of the tilt lever 24 configured to tilt manually, a configuration in which a motor or the like (not illustrated) for tilting electrically is provided is also applicable.

At this time, a length La in the short direction of the first seat surface member 7*a* is configured to be longer than a length Lb in the short direction of the second seat surface member 7*b*. Here, the "short direction" corresponds to the fore-and-aft direction when seated.

In this configuration, when folding the seat 7 (the first and second seat surface members 7*a*, 7*b*), the seat 7 may be held in the form of being inclined rearward at a predetermined inclination θ (set on the order of θ=10 to 15[°] as an example) as illustrated in FIG. 2A. Consequently, when tilting the second seat surface member 7*b* so as to be in a state illustrated in FIG. 2B from that in FIG. 2A by tilting the tilt lever 24 forward, the distal end of the first seat surface member 7*a* may make a sliding movement toward the front smoothly without being caught by the seat supporting frames 14*a*, 14*b*.

As described above, in this embodiment, the distal end of the first seat surface member 7*a* is configured to make the sliding movement on the seat supporting frames 14*a*, 14*b* to deploy the seat 7.

Here, the first seat surface member includes a sliding contact portion 7*x* coming into sliding contact with the seat supporting frames 14*a*, 14*b* at the time of folding and deploying. The sliding contact portion 7*x* is low in frictional resistance and is formed by using a resin material having an abrasion resistance (Teflon (registered trademark of Du Pont U.S.) for example). In this configuration, a force required for the operation may be reduced, and the nursing wheelchair sustainable over a long time of use is realized.

Also, in this embodiment, the backrest 8 is provided on the seat backrest mechanism 6. As an example, the backrest 8 is fixed to the metallic substantially angular C-shaped frame which constitutes the push handle 9. The structure of the backrest 8 is not specifically limited, and various structures such as a structure in which a cushion member is adhered to a plate-shaped member, a structure in which a cloth is wound around a pipe-shaped member, and a structure in which a cloth is extended on the substantially angular-shaped frame are conceivable.

Subsequently, a transfer action of the care receiver between the nursing wheelchair 1 of this embodiment and the platform of the bed or the toilet will be described with reference to FIG. 6A to FIG. 6F, and FIG. 7A to FIG. 7E.

Figures 6A, 6B, 6C, 6D, 6E, 6F:
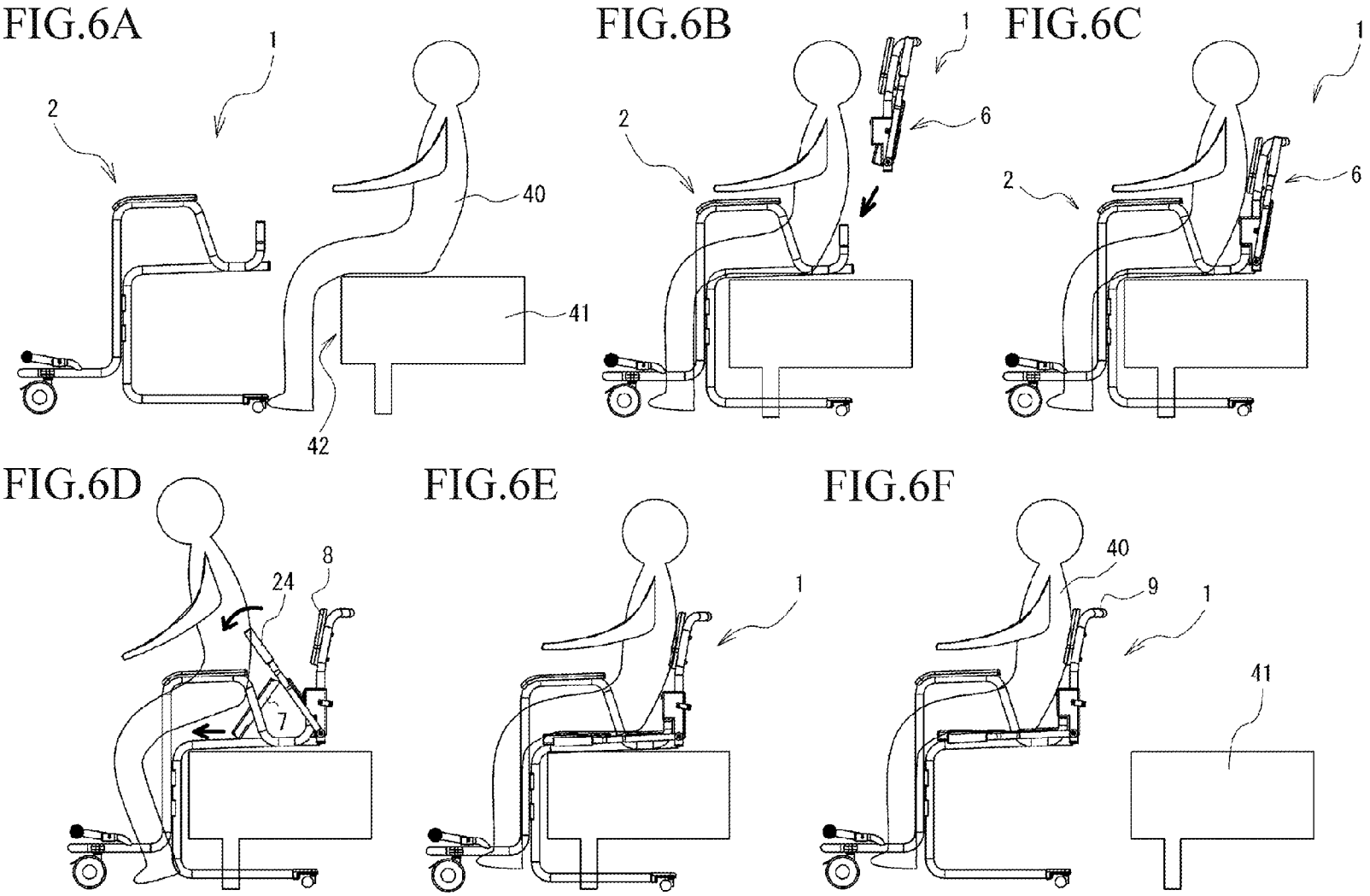
FIG. 6A to FIG. 6F are explanatory drawings for explaining a process of transferring a care receiver by the nursing wheelchair illustrated in FIG. 1A to FIG. 1D.

As an example, a care receiver 40 on the platform (bed 41) waits in a seated posture sitting down therein as illustrated in FIG. 6A. Then, the nursing wheelchair 1 (in a state in which the seat backrest mechanism 6 is not mounted) is advanced rearward and is arranged so as to be a state illustrated in FIG. 6B. At this time, the care receiver 40 is brought into a state of being positioned inside the frame member 2 of the nursing wheelchair 1. In this manner, the reason why the care receiver 40 in a state of sitting down on the platform of the bed 41 may enter between the side frame 3*a* and the side frame 3*b* from the back together with the platform is because the seat and the backrest, that is, the seat backrest mechanism 6 is demountably mountable with respect to the frame member 2. In addition, it is because the left and right two side frames 3*a*, 3*b* are coupled by the front bar 10 provided only in the front.

Furthermore, since the rear ends of the lower portions of the substantially L-shaped leg frames 15*a*, 15*b* coupled by the distal ends of the seat supporting frames 14*a*, 14*b* are arranged downward of the seat supporting frames 14*a*, 14*b*, and the seat supporting frames 14*a*, 14*b* and the leg frames 15*a*, 15*b* have a shape of a substantially angular C-shape in the coupled state, an arrangement in which the platform of the bed 41 is inserted under the seat supporting frames 14*a*, 14*b* is achieved, whereby the frame member 2 may be advanced rearward until a distal end portion 42 of the bed 41 comes into abutment with column portions of the leg frames 15*a*, 15*b* disposed in the substantially vertical direction. The frame member 2 is preferably provided with a height adjuster mechanism (not illustrated) which allows height adjustment of the seat supporting frames 14*a*, 14*b*.

Subsequently, the seat and the seatback, that is, the seat backrest mechanism 6 is mounted on the frame member 2 in a state in which the frame member 2 is arranged as in FIG. 6B. Accordingly, the state illustrated in FIG. 6C is assumed.

A mounting method at this time is as described above, and the seat backrest mechanism 6 may be mounted and fixed to the frame member 2 by fitting the extending portions 2*a*, 2*b* so as to be inserted into the socket portions 21 provided on the fixing portions 20 of the seat backrest mechanism 6. In this state, by pushing or pulling the push handle 9 forward and backward, the nursing wheelchair 1 may be moved in the fore-and-aft direction.

As another mounting method, as described in conjunction with FIG. 5A to FIG. 5C above, a mounting state is achieved by supporting the seat backrest mechanism 6 by one of the fixing portions 20 in a state of being opened with respect to one of the side frames (for example, 3*a*) (the sate in FIG. 5C), bringing the seat backrest mechanism 6 into a closed state by being rotated like a door, and then causing the other fixing portion 20 to make a sliding movement (downward movement) and fixing the same to the other side frame (for example, 3*b*) (the state illustrated in FIG. 5A).

Subsequently, the seat 7 is deployed as illustrated in FIG. 6D. The method of deployment of the seat 7 is as described above, and since the deployment is achieved only by the action to tilt the tilt lever 24 toward the near side, very good operability is provided.

Here, in order to deploy the seat 7 over the seat supporting frames 14*a*, 14*b*, the care receiver 40 needs to rise halfway from the seated state. For example, a method in which the care receiver 40 rises halfway from the seated state with his or her hands pushing against the armrest portions 4*a*, 4*b* himself or herself is conceivable.

At this point, in the nursing wheelchair 1 according to this embodiment, since the deployment of the seat 7 may be performed in a very short time, the time required for the care receiver 40 to rise halfway from the seated state may be very short. Therefore, the burden on the care receiver 40 is very light. Also, since good operability and workability when deriving the seat 7 are ensured, the nursing when there is only one care person is facilitated.

When the seat backrest mechanism 6 is mounted and the deployment of the seat 7 is completed, the care receiver 40 may be supported by the seat backrest mechanism 6 (that is, the seat 7 and the backrest 8) and brought into a state seated on the frame member 2 (see FIG. 6E). Consequently, as illustrated in FIG. 6F, transference of the care receiver 40 forward from on the platform of the bed 41 is enabled by the nursing wheelchair 1.

Figure 7A:
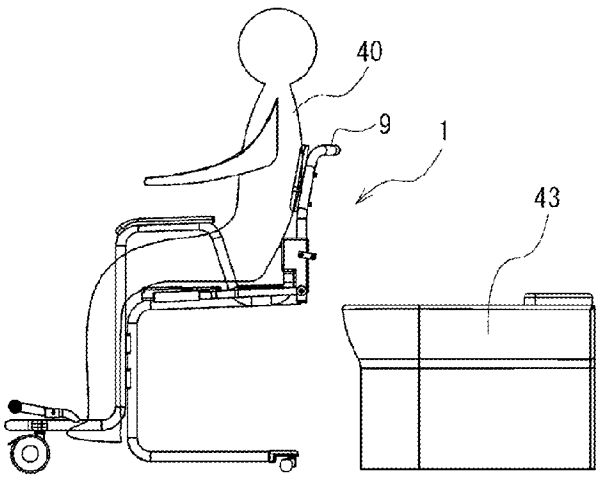
FIG. 7A to FIG. 7E are explanatory drawings for explaining a process of transferring the care receiver by the nursing wheelchair illustrated in FIG. 1A to FIG. 1D.

Subsequently, the nursing wheelchair 1 is advanced rearward with respect to the platform of a destination (a toilet 43 in this embodiment) as illustrated in FIG. 7A. Here, since the frame member 2 allows insertion of the toilet 43 from the back, the toilet 43 may be inserted to a position illustrated in FIG. 7B in a state in which the care receiver 40 is seated on the nursing wheelchair 1. This is because of a configuration in which the position of the seat 7, that is, the positions of the seat supporting frames 14*a*, 14*b* are provided above the seat surface of the platform (the toilet 43 in this case) and, in addition, the left and right two side frames 3*a*, 3*b* are coupled by the front bar 10 provided only in the front.

Figure 7B:
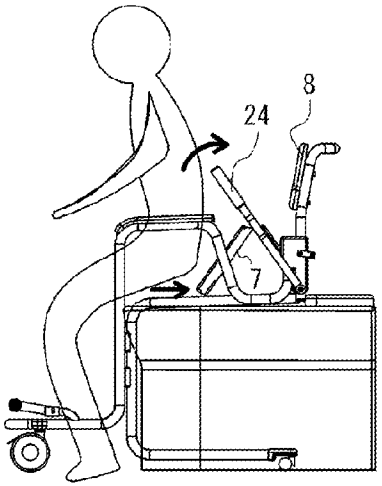

Subsequently, at the position illustrated in FIG. 7B, the care receiver 40 is bent forward and held in a state of rising halfway from the seated state and the seat 7 is folded. Here, since the method of folding the seat 7 is achieved only by the action of tilting the tilt lever 24 so as to pull upward from the near side, very good operability is provided.

Here, in order to fold the seat 7, the care receiver 40 needs to rise halfway from the seated state. For example, a method in which the care receiver 40 half rises from the wheelchair with his or her hands pushing against the armrest portions 4*a*, 4*b* himself or herself is conceivable. In addition, since a coupling portion between the seat surface members 7*a*, 7*b* of the seat 7 moves upward by the action of tilting the tilt lever 24 so as to pull upward from the near side, an action of the coupling portion to push up the breech of the care receiver 40 is generated, so that an effect to assist the care receiver to rise halfway from the seated state is obtained.

In this manner, in the nursing wheelchair 1 according to this embodiment, since the folding of the seat 7 may be performed in a very short time, and the time required for the care receiver 40 to rise halfway from the wheelchair may be very short. In addition, since an operation for assisting the action to rise halfway from the seated state is also obtained, the burden on the care receiver 40 is very small. Therefore, it is also effective in terms of independent support of the care receiver. In addition, since the action to transfer in the lateral direction or rotate the nursing wheelchair 1 is eliminated, an effect of preventing the care receiver 40 from falling is also achieved. Also, since good operability and workability when folding the seat 7 are ensured, the nursing when there is only one care person is facilitated.

Figure 7C:
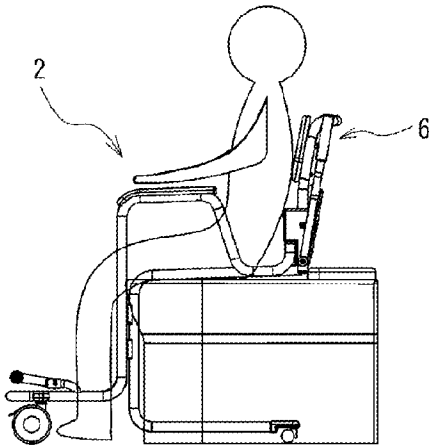

Subsequently, the care receiver 40 is allowed to be seated on the seat surface of the toilet 43 by taking a state of sitting down from the state of rising halfway from the seated state after the seat 7 has been folded as illustrated in FIG. 7C.

Figure 7D:
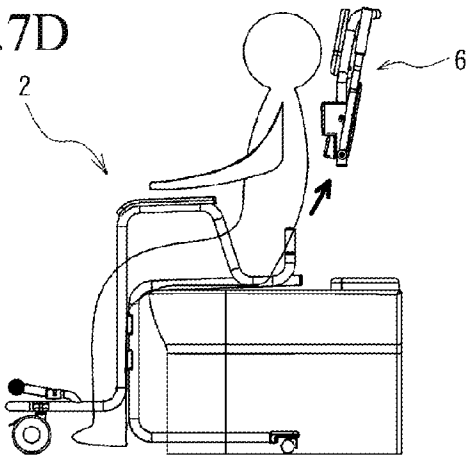

Subsequently, the seat backrest mechanism 6 in the state in which the seat 7 is folded is removed from the frame member 2 as illustrated in FIG. 7D. Since the seat backrest mechanism 6 is removable only by gripping and lifting upward the push handle 9, very good operability is provided.

As another method, the seat backrest mechanism 6 may be brought into an opened state (the state illustrated in FIG. 5C) by causing one of the fixing portions 20 to support the seat backrest mechanism 6 so as to be rotatable with respect to one of the side frames (for example, 3*a*) (the state illustrated in FIG. 5A) and rotate like a door.

Figure 7E:
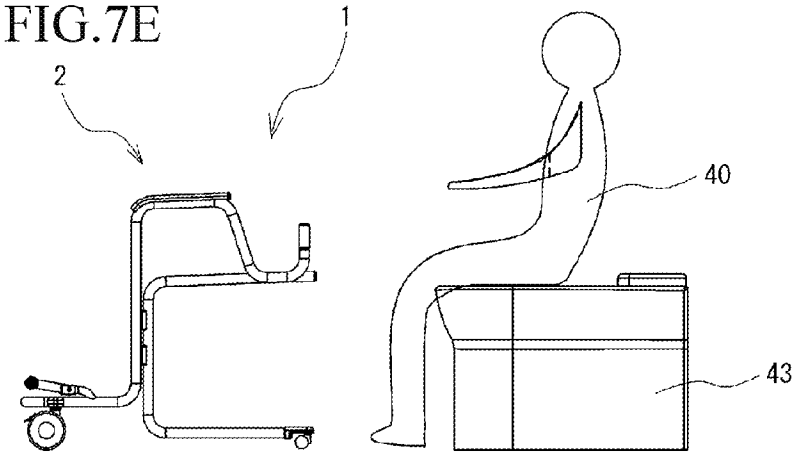
Figure 8A:
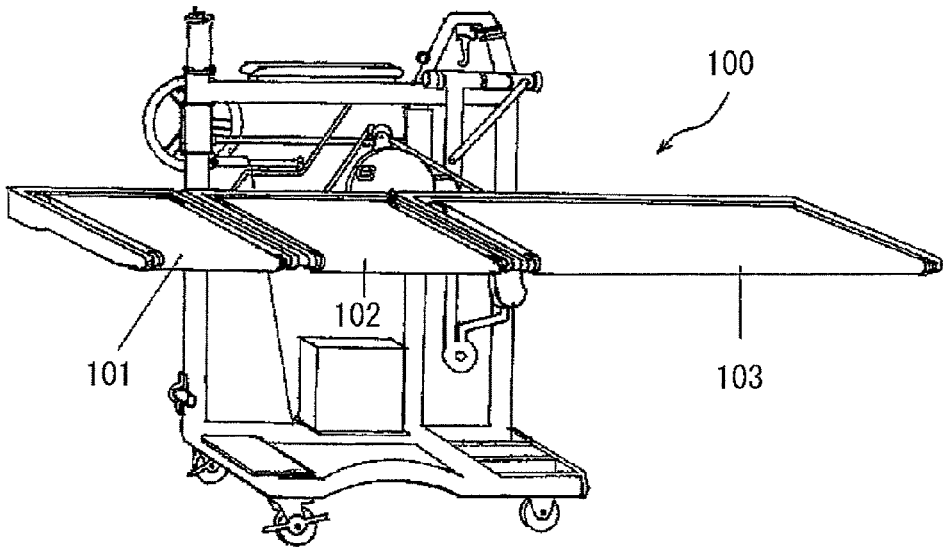
FIG.8A PRIOR ART
FIG. 8A and FIG. 8B are schematic drawings illustrating an example of a nursing wheelchair according to an embodiment of the related art.
Figure 8B:
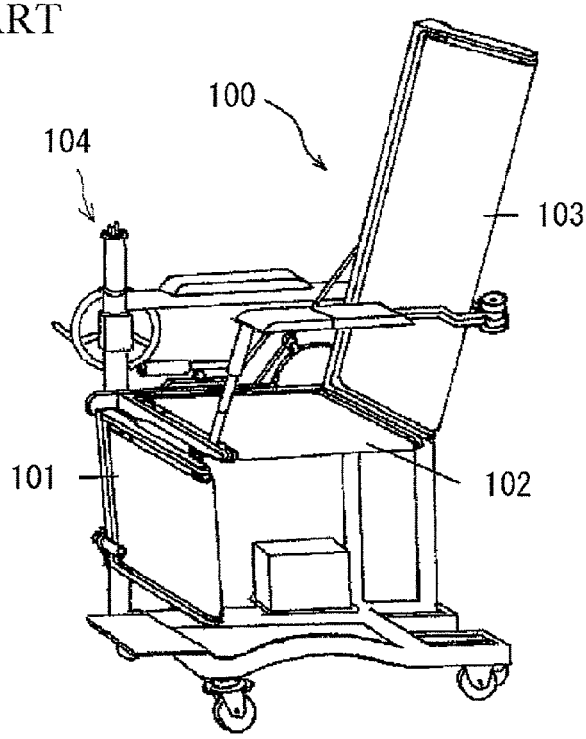
FIG.8B PRIOR ART

In this state, the frame member 2 may be pulled out and transferred forward as illustrated in FIG. 7E.

In this manner, the transference of the care receiver 40 from a platform (bed) to a platform (toilet) for example is completed.

As described above, according to the nursing wheelchair of the present invention, the care receiver having a difficulty in walking can be transferred between the platform of a bed and the nursing wheelchair easily by a light-weight and simple structure without employing a large scale hoisting mechanism, a rotating mechanism, or the like.

In comparison with the nursing wheelchair of the related art, dramatic improvement of workability is enabled. In particular, since mounting and demounting, and rotation of the seat and the seatback are easy, and deployment and folding of the seat may be performed only by an action of tilting the tilt lever, so that very good operability is provided, and the operation may be performed in a very short time. Accordingly, reduction of the physical burden on the care receiver is enabled, and it is also effective in terms of independent support of the care receiver. Also, an effect of preventing the care receiver from falling is also achieved. Furthermore, the nursing by a single care person is also facilitated.

The nursing wheelchair according to the present invention realizes a light-weight and simple structure. Such a light-weight structure contributes to reduction of labor required for transference by the care person, the simple structure brings about reduction of manufacturing costs, and as a consequence, reduces the burden of expenses at purchasers.

Also, it is also a significant effect that the nursing of the care receiver may be performed as described above while enabling the usage of existing facilities such as the bed and the toilet as-is without modifying or replacing by using the nursing wheelchair according to the present invention.

The present invention is not limited to the examples described above, and various modifications may be made without departing the present invention.

What is claimed is:

1. A nursing wheelchair comprising:

a seat configured to be supported demountably or rotatably by a frame member, wherein the frame member including a seat supporting frame and a leg frame to be coupled to a front end portion of the seat supporting frame, the seat supporting frame and the leg frame being coupled so as to form a substantially angular C-shape in side view, the seat including one or a plurality of foldable and deployable seat surface members configured to form a seat surface by being deployed over the seat supporting frame, the seat surface member including a first seat surface member at a front position and a second seat surface member at a rear position when the seat is in a deployed position, and the first seat surface member and the second seat surface member being coupled so as to be foldable and deployable;

a tilting mechanism configured to tilt the second seat surface member, wherein the first and second seat surface members are deployed over the seat supporting frame by moving a distal end of the first seat surface member forward along the seat supporting frame by tilting the second seat surface member by the tilting mechanism;

the tilting mechanism is provided on a seat backrest mechanism, and the seat backrest mechanism is detachable from and rotatable with respect to a rear end portion of the frame member, such that when the seat backrest mechanism is detached or rotated with respect to the rear end portion of the frame member the tilting mechanism is detached or rotated, respectively, to accompany with the seat backrest mechanism, and a distal end of the first seat surface member is slidably supported by the seat supporting frame when the seat and seat backrest mechanism is fixed to a predetermined position at a rear end portion of the frame member.

2. The nursing wheelchair according to claim 1, wherein the tilting mechanism includes a rotary shaft member provided on the second seat surface member and a tilting lever fixed to the rotary shaft member.

3. The nursing wheelchair according to claim 2, wherein the length of the first seat surface member in the short direction corresponding to the fore-and-aft direction when the seat is in a deployed position is longer than that of the second seat surface member.

4. The nursing wheelchair according to claim 3, wherein the first seat surface member includes a sliding contact portion configured to come into sliding contact with the seat supporting frame at the time of folding and deployment.

5. The nursing wheelchair according to claim 1, wherein the length of the first seat surface member in the short direction corresponding to the fore-and-aft direction when the seat is in a deployed position is longer than that of the second seat surface member.

6. The nursing wheelchair according to claim 5, wherein the first seat surface member includes a sliding contact portion configured to come into sliding contact with the seat supporting frame at the time of folding and deployment.

7. The nursing wheelchair according to claim 1, wherein the first seat surface member includes a sliding contact portion configured to come into sliding contact with the seat supporting frame at the time of folding and deployment.

8. The nursing wheelchair according to claim 2, wherein the first seat surface member includes a sliding contact portion configured to come into sliding contact with the seat supporting frame at the time of folding and deployment.

* * * * *